US006842140B2

(12) United States Patent
Killen et al.

(10) Patent No.: US 6,842,140 B2
(45) Date of Patent: Jan. 11, 2005

(54) HIGH EFFICIENCY SLOT FED MICROSTRIP PATCH ANTENNA

(75) Inventors: William D. Killen, Melbourne, FL (US); Randy T. Pike, Grant, FL (US); Heriberto Jose Delgado, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/308,500

(22) Filed: Dec. 3, 2002

(65) Prior Publication Data

US 2004/0104847 A1 Jun. 3, 2004

(51) Int. Cl.[7] ..... H01Q 1/38
(52) U.S. Cl. ..... 343/700 MS
(58) Field of Search ..... 343/700 MS, 787

(56) References Cited

U.S. PATENT DOCUMENTS

| | | | | |
|---|---|---|---|---|
| 3,571,722 A | | 3/1971 | Vendelin | |
| 3,678,418 A | | 7/1972 | Woodward | |
| 4,495,505 A | | 1/1985 | Shields | |
| 4,525,720 A | | 6/1985 | Corzine et al. | |
| 4,717,921 A | * | 1/1988 | Ohe et al. | 343/712 |
| 4,800,344 A | | 1/1989 | Graham | |
| 4,825,220 A | | 4/1989 | Edward et al. | |
| 4,882,553 A | | 11/1989 | Davies et al. | |
| 4,916,410 A | | 4/1990 | Littlefield | |
| 4,924,236 A | | 5/1990 | Schuss et al. | |
| 5,039,552 A | | 8/1991 | Riemer | |
| 5,148,130 A | | 9/1992 | Wen et al. | |
| 5,379,006 A | | 1/1995 | McCorkle | |
| 5,455,545 A | | 10/1995 | Garcia | |
| 5,515,059 A | * | 5/1996 | How et al. | 342/372 |
| 5,523,728 A | | 6/1996 | McCorkle | |
| 5,678,219 A | | 10/1997 | Agarwal et al. | |
| 6,052,039 A | | 4/2000 | Chiou et al. | |
| 6,114,940 A | | 9/2000 | Kakinuma et al. | |
| 6,121,936 A | * | 9/2000 | Hemming et al. | 343/769 |
| 6,133,806 A | | 10/2000 | Sheen | |
| 6,137,376 A | | 10/2000 | Imbornone et al. | |
| 6,184,845 B1 | | 2/2001 | Leisten et al. | |
| 6,281,845 B1 | | 8/2001 | Ittipiboon et al. | |
| 6,307,509 B1 | | 10/2001 | Krantz | |
| 6,597,318 B1 | * | 7/2003 | Parsche et al. | 343/700 MS |
| 2003/0129405 A1 | * | 7/2003 | Zhang et al. | 428/403 |

OTHER PUBLICATIONS

U.S. Appl. No. 10/448,973, filed May 30, 2003, Delgado et al.
U.S. Appl. No. 10/184,277, filed Jun. 27, 2002, Killen et al.
U.S. Appl. No. 10/185,443, filed Jun. 27, 2002, Killen et al.
U.S. Appl. No. 10/184,332, filed Jun. 27, 2002, Killen et al.
U.S. Appl. No. 10/185,251, filed Jun. 27, 2002, Parsche et al.
U.S. Appl. No. 10/185,847, filed Jun. 27, 2002, Killen et al.
U.S. Appl. No. 10/185,275, filed Jun. 27, 2002, Killen et al.
U.S. Appl. No. 10/185,273, filed Jun. 27, 2002, Killen et al.
U.S. Appl. No. 10/373,935, filed Feb. 25, 2003, Killen et al.

(List continued on next page.)

*Primary Examiner*—Tho Phan
(74) *Attorney, Agent, or Firm*—Sacco & Associates, PA

(57) ABSTRACT

A slot fed microstrip patch antenna (200) includes an electrically conducting ground plane (208), the ground plane (208) having at least one coupling slot (206) and at least a first patch radiator (209). An antenna dielectric substrate material (205) is disposed between the ground plane (208) and the first patch radiator (209), wherein at least a portion of the antenna dielectric (210) includes magnetic particles (214). A feed dielectric substrate (212) is disposed between a feed line (217) and the ground plane (208). Magnetic particles can also be used in the feed line (217) dielectric. Patch antennas according to the invention can be of a reduced size through use of high relative permittivity dielectric substrate portions, yet still be efficient through use of dielectrics including magnetic particles which permit impedance matching of dielectric medium interfaces, such as the feed line (217) into the slot (206).

10 Claims, 5 Drawing Sheets

OTHER PUBLICATIONS

U.S. Appl. No. 10/404,285, filed Mar. 31, 2003, Killen et al.
U.S. Appl. No. 10/404,981, filed Mar. 31, 2003, Killen et al.
U.S. Appl. No. 10/404,960, filed Mar. 31, 2003, Killen et al.
U.S. Appl. No. 10/185,144, filed Jun. 27, 2002, Killen et al.
U.S. Appl. No. 10/185,266, filed Jun. 27, 2002, Killen et al.
U.S. Appl. No. 10/185,162, filed Jun. 27, 2002, Rumpft, Jr. et al.
U.S. Appl. No. 10/185,824, filed Jun. 27, 2002, Killen et al.
U.S. Appl. No. 10/185,187, filed Jun. 27, 2002, Killen et al.
U.S. Appl. No. 10/185,855, filed Jun. 27, 2002, Killen et al.
U.S. Appl. No. 10/185,459, filed Jun. 27, 2002, Killen et al.
U.S. Appl. No. 10/185,480, filed Jun. 27, 2002, Killen et al.
U.S. Appl. No. 10/439,094, filed May 15, 2003, Delgado et al.

* cited by examiner

HIGH EFFICIENCY SLOT FED MICROSTRIP PATCH ANTENNA

BACKGROUND OF THE INVENTION

1. Statement of the Technical Field

The inventive arrangements relate generally microstrip patch antennas and more particularly to slot fed microstrip patch antennas.

2. Description of the Related Art

RF circuits, transmission lines and antenna elements are commonly manufactured on specially designed substrate boards. Conventional circuit board substrates are generally formed by processes such as casting or spray coating which generally result in uniform substrate physical properties, including the dielectric constant.

For the purposes RF circuits, it is generally important to maintain careful control over impedance characteristics. If the impedance of different parts of the circuit do not match, signal reflections and inefficient power transfer can result. Electrical length of transmission lines and radiators in these circuits can also be a critical design factor.

Two critical factors affecting circuit performance relate to the dielectric constant (sometimes referred to as the relative permittivity or $\in_r$) and the loss tangent (sometimes referred to as the dissipation factor) of the dielectric substrate material. The relative permittivity determines the speed of the signal in the substrate material, and therefore the electrical length of transmission lines and other components disposed on the substrate. The loss tangent determines the amount of loss that occurs for signals traversing the substrate material. Dielectric losses increase as the signal frequency increases. Accordingly, low loss materials become even more important with increasing frequency, particularly when designing receiver front ends and low noise amplifier circuits.

Printed transmission lines, passive circuits and radiating elements used in RF circuits are typically formed in one of three ways. One configuration known as microstrip, places the signal line on a board surface and provides a second conductive layer, commonly referred to as a ground plane. A second type of configuration known as buried microstrip is similar to microstrip except that the signal line is covered with a dielectric substrate material. In a third configuration known as stripline, the signal line is sandwiched between two electrically conductive (ground) planes.

In general, the characteristic impedance of a parallel plate transmission line, such as stripline or microstrip, is approximately equal to $\sqrt{L_1/C_1}$, where $L_1$ is the inductance per unit length and $C_1$ is the capacitance per unit length. The values of $L_1$ and $C_1$ are generally determined by the physical geometry, the spacing of the line structure, as well as the permittivity and permeability of the dielectric material(s) used to separate the transmission lines.

In conventional RF designs, a substrate material is selected that has a single relative permittivity value and a single relative permeability value, the relative permeability value being about 1. Once the substrate material is selected, the line characteristic impedance value is generally exclusively set by controlling the geometry of the line.

Radio frequency (RF) circuits are typically embodied in hybrid circuits in which a plurality of active and passive circuit components are mounted and connected together on a surface of an electrically insulating board substrate, such as a ceramic substrate. The various components are generally interconnected by printed metallic conductors, such as copper, gold, or tantalum, which generally function as transmission lines (e.g. stripline or microstrip or twin-line) in the frequency ranges of interest.

The dielectric constant of the selected substrate material for a transmission line, passive RF device, or radiating element determines the physical wavelength of RF energy at a given frequency for that structure. One problem encountered when designing microelectronic RF circuitry is the selection of a dielectric board substrate material that is reasonably suitable for all of the various passive components, radiating elements and transmission line circuits to be formed on the board.

In particular, the geometry of certain circuit elements may be physically large or miniaturized due to the unique electrical or impedance characteristics required for such elements. For example, many circuit elements or tuned circuits may need to have a length of a quarter wavelength. Similarly, the line widths required for exceptionally high or low characteristic impedance values can, in many instances, be too narrow or too wide for practical implementation. Since the physical size of the microstrip or stripline is inversely related to the relative permittivity of the dielectric material, the dimensions of a transmission line or a radiator element can be affected greatly by the choice of substrate board material.

Still, an optimal board substrate material design choice for some components may be inconsistent with the optimal board substrate material for other components, such as antenna elements. Moreover, some design objectives for a circuit component may be inconsistent with one another. For example, it may be desirable to reduce the size of an antenna element. This could be accomplished by selecting a board material with a high relative permittivity, such as 50 to 100. However, the use of a dielectric with a high relative permittivity will generally result in a significant reduction in the radiation efficiency of the antenna.

Antenna elements are sometimes configured as microstrip antennas. Microstrip antennas are useful antennas since they generally require less space and are generally simpler and are generally less expensive to manufacture as compared to other antenna types. In addition, importantly, microstrip antennas are highly compatible with printed-circuit technology.

One factor in constructing a high efficiency microstrip antenna is minimizing power loss, which may be caused by several factors including dielectric loss. Dielectric loss is generally due to the imperfect behavior of bound charges, and exists whenever a dielectric material is placed in a time varying electrical field. Dielectric loss generally increases with operating frequency.

The extent of dielectric loss for a particular microstrip antenna is primarily determined by the dielectric constant of the dielectric space between the radiator patch and the ground plane for a patch antenna having a single patch. Free space, or air for most purposes, has a relative dielectric constant approximately equal to one.

A dielectric material having a relative dielectric constant close to one is considered a "good" dielectric material. A good dielectric material exhibits low dielectric loss at the operating frequency of interest. When a dielectric material having a relative dielectric constant substantially equal to the surrounding materials is used, the dielectric loss is effectively eliminated. Therefore, one method for maintaining high efficiency in a microstrip antenna system involves the use of a material having a low dielectric constant in the dielectric space between the radiator patch and the ground plane.

Furthermore, the use of a material with a low relative dielectric constant permits the use of wider transmission lines that, in turn, reduces conductor losses and further improves the radiation efficiency of the microstrip antenna. However, the use of a dielectric material having a low dielectric constant can present certain disadvantages.

One typical disadvantage is that it is difficult to produce high-speed compact patch antennas spaced from a ground plane using a low dielectric constant dielectric. When a dielectric material having a low relative dielectric constant (such as 1–4) is disposed between a patch and a ground plane, the resulting patch size is large, sometimes large enough to preclude use in a given application, such as in some RF communication systems.

Another problem with microstrip antennas is that the feed efficiency often degrades substantially as the patch is spaced further away from the ground plane. That said, more spacing of the patch from the ground plane is also advantageous and, as such, is usually accommodated using dielectric material with a higher dielectric constant to fill the space between the patch and the ground plane. Unfortunately, efficiency is generally substantially compromised in order to meet other design parameters.

SUMMARY OF THE INVENTION

A slot fed microstrip patch antenna includes an electrically conducting ground plane, the ground plane having at least one coupling slot and at least a first patch radiator. An antenna dielectric substrate material is disposed between the ground plane and the first patch radiator. At least a portion of the antenna dielectric includes magnetic particles. A feed dielectric substrate is disposed between a feed line and the ground plane.

Dielectrics used previously for microwave circuit board substrates have been nonmagnetic. Even outside the field of microwave circuits, materials used for their dielectric properties have been generally nonmagnetic, nonmagnetic defined as having a relative permeability of 1 ($\mu_r$=1).

In engineering applications, permeability is often expressed in relative, rather than in absolute, terms. If $\mu_o$ represents the permeability of free space (that is, $1.257\times10^{-6}$H/m) and $\mu$ represents the permeability of the material in question, then the relative permeability, $\mu r$, is given by: $\mu r=\mu/\mu o=\mu(7.958\times10^5)$.

Magnetic materials are materials having $\mu_r$ either greater than 1, or less than 1. Magnetic materials are commonly classified into the three groups described below.

Diamagnetic materials are materials which provide a relative permeability of less than one, but typically from 0.99900 to 0.99999. For example, bismuth, lead, antimony, copper, zinc, mercury, gold, and silver are known diamagnetic materials. Accordingly, when subjected to a magnetic field, these materials produce a slight decrease in magnetic flux as compared to a vacuum.

Paramagnetic materials are materials which provide a relative permeability of greater than one and up to about 10. Paramagnetic materials include materials such as aluminum, platinum, manganese, and chromium. Paramagnetic materials generally lose their magnetic properties immediately after an external magnetic field is removed.

Ferromagnetic materials are materials which provide a relative permeability greater than 10. Ferromagnetic materials include a variety of ferrites, iron, steel, nickel, cobalt, and commercial alloys, such as alnico and peralloy. Ferrites, for example, are made of ceramic material and have relative permeabilities that range from about 50 to 200.

As used herein, the term "magnetic particles" refers to particles when intermixed with dielectric materials result in a $\mu_r$ of greater than 1 for the resulting dielectric material. Accordingly, ferromagnetic and paramagnetic materials are generally included in this definition, while diamagnetic particles are generally not included.

Through the use of magnetic particles in dielectric substrates, microstrip patch antennas according to the invention can be of a reduced size through use of high relative permittivity substrate portions, yet still be efficient. Although previous dielectric loaded substrates provided reduced size patch antennas, these antennas lacked efficiency as impedance matching of the feed line into the slot and the slot into free space suffered. Through the addition of magnetic materials in dielectric substrates according to the invention, such as the antenna and/or the feed line substrates, the radiation efficiency degradation generally associated with use of a high permittivity substrates can be substantially reduced.

The portion of the antenna dielectric disposed between the slot and the patch can include magnetic particles. The use of magnetic particles in this region can provide an intrinsic impedance which substantially matches an intrinsic impedance of the feed line dielectric in the region between the slot and the feed line at an operating frequency of the antenna. As used herein, the phrase "substantially matching" of dielectrics indicates impedance matching of two mediums within 20%, preferably within 10%, more preferably within 5% at an operating frequency of the antenna. The portion of the antenna dielectric having magnetic particles can have a relative permeability of at least at least 2.

A portion of the feed line dielectric can also include magnetic particles, such as disposed between the slot and said feed line. The magnetic particles can comprise metamaterials.

The feed line dielectric can provide a quarter wavelength matching section proximate to the slot to impedance match the feed line into said slot. The quarter wave matching section can also include magnetic particles.

The antenna can have two or more patch radiators, such as a first patch radiator and a second patch radiator, the first and said second patch radiators separated by an inter-patch dielectric. The inter-patch dielectric can include magnetic particles, such as metamaterials.

DETAILED DESCRIPTION OF THE PREFERRED EMBODIMENTS

Low dielectric constant board materials are ordinarily selected for RF printed board circuit designs. For example, polytetrafluoroethylene (PTFE) based composites such as RT/duroid® 6002 (dielectric constant of 2.94; loss tangent of 0.009) and RT/duroid® 5880 (dielectric constant of 2.2; loss tangent of 0.0007) are both available from Rogers Microwave Products, Advanced Circuit Materials Division, 100 S. Roosevelt Ave, Chandler, Ariz. 85226. Both of these materials are common board material choices. The above board materials are uniform across the board area in terms of thickness and physical properties and provide dielectric layers having relatively low dielectric constants with accompanying low loss tangents. The relative permeability of both of these materials is nearly 1.

Foams are sometimes used as dielectric materials between certain circuit layers. For example, RH-4 structural foam is sometimes used, such as an antenna spacer between patch radiators in microstrip antennas having stacked radiators. As with conventional dielectric substrates, available foams have uniform dielectric properties, such as a relative permittivity of about 2 to 4, and a relative permeability of nearly 1.

Figure 1:
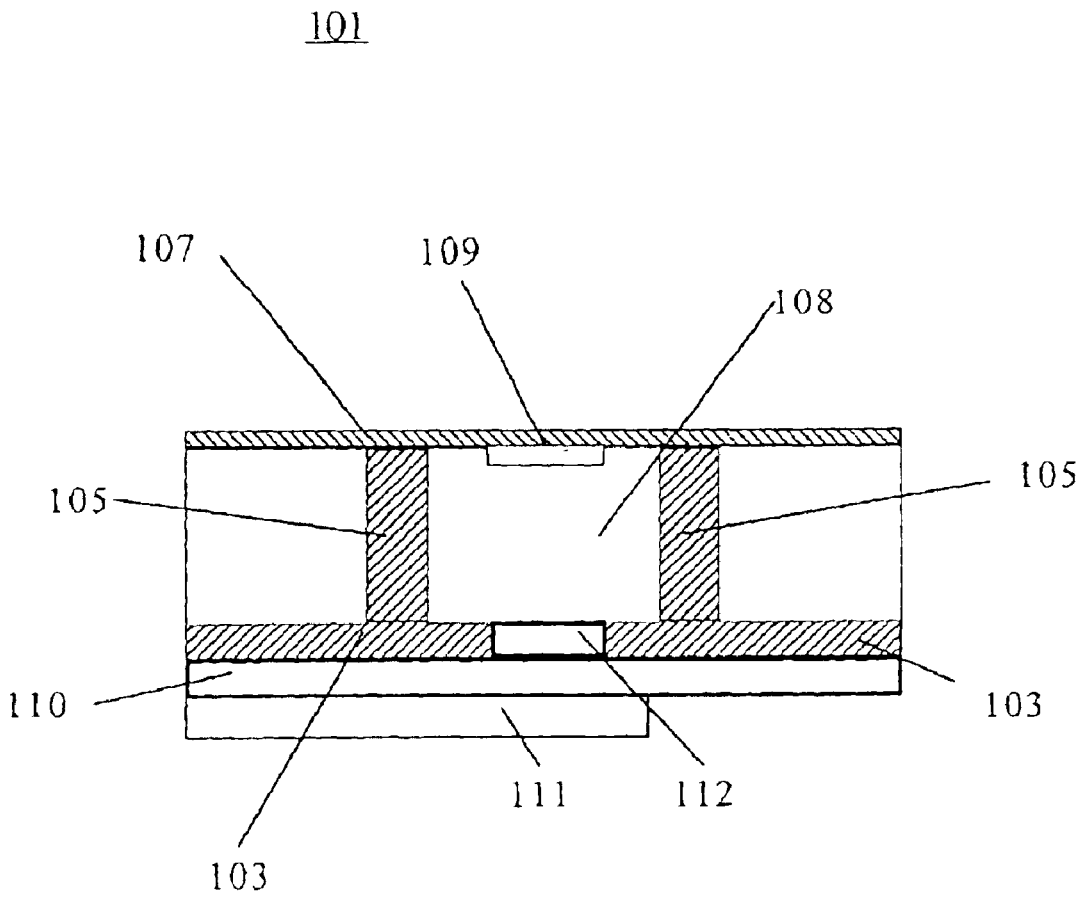
FIG. 1 PRIOR ART
FIG. 1 is a side view of a slot coupled microstrip patch antenna according to the prior art.

Referring to FIG. 1, a side view of a prior art air spaced patch antenna 101 is shown. In its simplest form, a microstrip patch antenna comprises a radiator patch that is separated from a ground plane by a dielectric space. In this case, the dielectric shown is air.

In FIG. 1, the patch antenna 101 comprises a thin substrate layer 107 made of a dielectric material having suitable dielectric and rigidity properties. Disposed on a bottom face of the substrate layer 107 is a radiator patch 109, made of electrically conductive material. The radiator patch 109 is generally made by appropriate etching of the thin substrate layer 107 having one or both faces entirely coated with the electrically conductive material.

Supporting the substrate layer 107 and radiator patch 109 is ground plane 103 made of electrically conductive material having a plurality of integral support posts 105 extending substantially perpendicularly from one face of the ground plane 103 to substrate layer 107. Ground plane 113 includes coupling slot region 112, which provides an aperture therein. Air fills region 108 which underlies substrate layer 107 and patch radiator 109.

Feed substrate 110 underlies ground plane 103. Microstrip line 111 is disposed on feed substrate 110 and provides a signal path to transfer signal energy to and from radiator patch 109, principally through coupling slot 112.

The prior art patch antenna 101 shown in FIG. 1 is satisfactory for certain applications, but can require a size prohibiting its application in some designs. In an effort to reduce the size of the antenna, the air dielectric 108 can be replaced by a dielectric material having a substantially higher dielectric constant. However, the use of a high dielectric constant material generally reduces the radiation efficiency of the antenna. This results in inefficiencies and trade-offs in the antenna design to balance these trade offs.

By comparison, the present invention provides the circuit designer with an added level of flexibility. By permitting the use of dielectric layers, or a portions thereof, which have locally selectively controlled permittivity and permeability properties, antennas can be optimized with respect to efficiency, functionality and physical profile.

The locally selectable dielectric and magnetic characteristics of dielectric substrates may be realized by including metamaterials in the dielectric substrate, or preferably portions thereof. Metamaterials refer to composite materials formed by mixing of two or more different materials at a very fine level, such as the molecular or nanometer level.

According to the present invention, an antenna design is presented that can provide an antenna having the reduced size through use of a high dielectric constant antenna substrate, or portions thereof, while providing high radiation efficiency which was heretofore only available by disposing the radiating antenna on a low dielectric constant antenna substrate. In addition, the invention can provide impedance matching from the feed line into the slot. Thus, the invention can substantially overcome the inefficiencies and trade-offs in prior art microstrip patch antenna designs.

Figure 2:
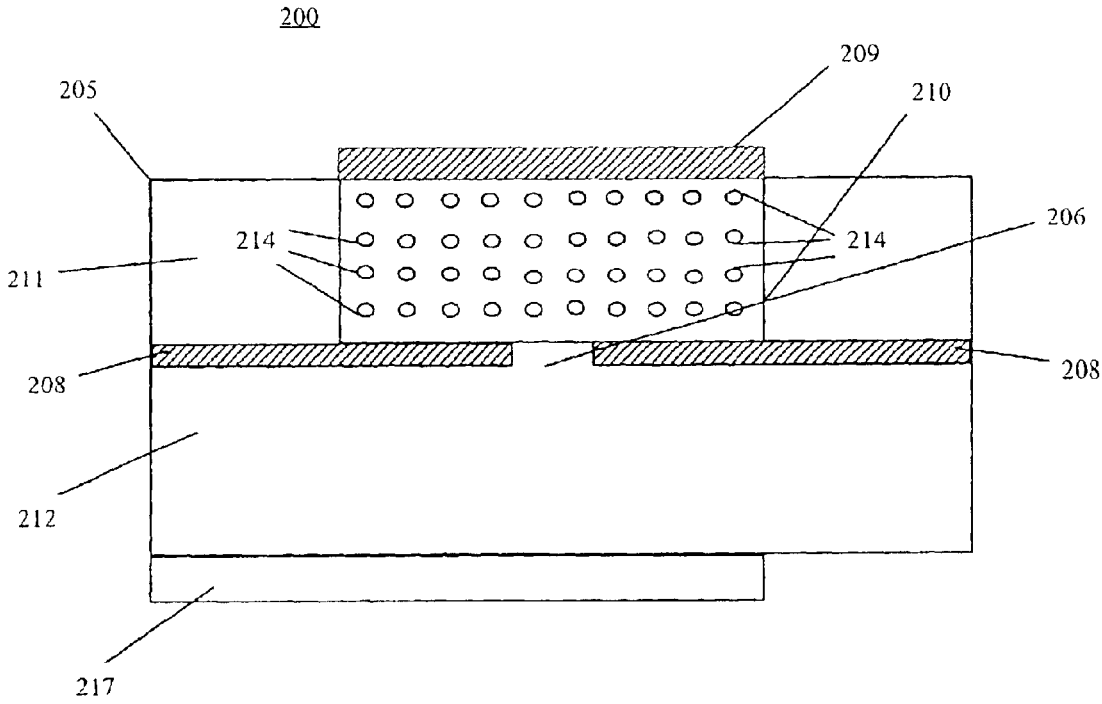
FIG. 2 is a side view of a slot fed microstrip patch antenna formed on an antenna dielectric which includes magnetic particles for improving the radiation efficiency of the antenna, according to an embodiment of the invention.

Referring to FIG. 2, a side view of a slot fed microstrip patch antenna 200 according to an embodiment of the invention is shown. This embodiment has similar elements to the prior art antenna of FIG. 1, except antenna 200 includes an optimized antenna substrate dielectric material 205.

Antenna substrate 205 includes first antenna dielectric region 210 which underlies patch radiator 209, and second antenna dielectric region 211 which can comprise the remainder of antenna substrate 205. Antenna substrate 205 is disposed over ground plane 208, the ground plane having at least one coupling slot 206.

First antenna dielectric region 210 includes a plurality of magnetic particles 214 embedded therein. Although not shown, antenna 200 can include an optional dielectric cover disposed over patch radiator 209.

Feed dielectric substrate 212 underlies ground plane 208. Microstrip feed line 217 is provided for delivering signal energy to, or receiving signal energy from, patch radiator 209 through slot 206. Microstrip line 217 may be driven by a variety of sources via a suitable connector and interface.

Although feed dielectric substrate 212 is not shown as having magnetic particles therein, magnetic particles can be included. For example, magnetic particles can be disposed in the feed line dielectric between the slot and the feed line to provide a desired intrinsic impedance in this region. Magnetic particles in feed dielectric substrate 212 can also be used to provides a quarter wavelength matching section proximate to the slot to impedance match the feed line into the slot.

For certain applications, antenna substrate 205 can exclusively comprise first antenna dielectric region 210. In other applications, magnetic particles 214 will only be included in a portion of first antenna dielectric region 210, such as only in a surface portion thereof.

Magnetic particles 214 can be metamaterial particles, which can be inserted into voids created in the antenna substrate 205, as discussed in detail later. The ability to include magnetic particles in first antenna dielectric region 210 permits improved impedance matching between both first antenna dielectric region 210 and the environment (e.g. air) and between first antenna dielectric region 210 and the dielectric media in region comprising slot 206. The relative permeability of first antenna dielectric region 210 is generally greater than 1, such as 1.1, 2, 5, 10, 20 or 100. As used herein, significant magnetic permeability refers to a relative magnetic permeability of at least about 2.

Although antenna 200 is shown with a single patch radiator 209, the invention may be practiced with stacked patch radiator structures, such as a microstrip patch antenna having an upper and lower patch radiator, the respective patches separated by an inter-patch dielectric substrate material. In this two patch arrangement, the inter-patch dielectric material preferably includes magnetic particles and provides a relative permeability of greater than 1.

Although the feed line shown is a microstrip feed line 217, the invention is clearly not limited to microstrip feeds. For example, the feed line can be a stripline or other suitable feed line structure.

In addition, although the ground plane 208 is shown as having a single slot 206, the invention is compatible with multislot arrangements. In addition, slots may generally be any shape that provides adequate coupling between microstrip feed line 217 and patch radiator 210, such as rectangular or annular.

First antenna dielectric region 210 significantly influences the electromagnetic fields radiated through the slot. Careful selection of the dielectric material, size, shape, and location can results in improved coupling between the slot 206 and the patch 209, even with substantial distances between them. By properly loading patch 209, its operational characteristics including resonating frequency and its quality factor which is related to operational bandwidth can be modified to fit a given design criteria.

The invention permits use of higher permittivity antenna substrates which permit a reduction in the physical size of patch 209 and the entire antenna 200 as a result, without a significant loss in efficiency. For example, the relative permittivity of antenna substrate 205 including first antenna substrate region 210 can be 2, 4, 6, 8, 10, 20, 30, 40, 50, 60 or higher, or values in between these values.

One problem in the prior art with increasing the relative permittivity in the dielectric region beneath radiating elements, such as patch 209, is that radiation efficiency of the antenna 200 may be reduced as a result. Microstrip antennas printed on high dielectric constant and relatively thick substrates tend to exhibit poor radiation efficiency. With dielectric substrates having higher values of relative permittivity, a larger amount of the electromagnetic field is concentrated in the dielectric between the conductive antenna element and the ground plane. Poor radiation efficiency under such circumstances is often attributed in part to surface wave modes propagating along the air/substrate interface.

Figure 3:
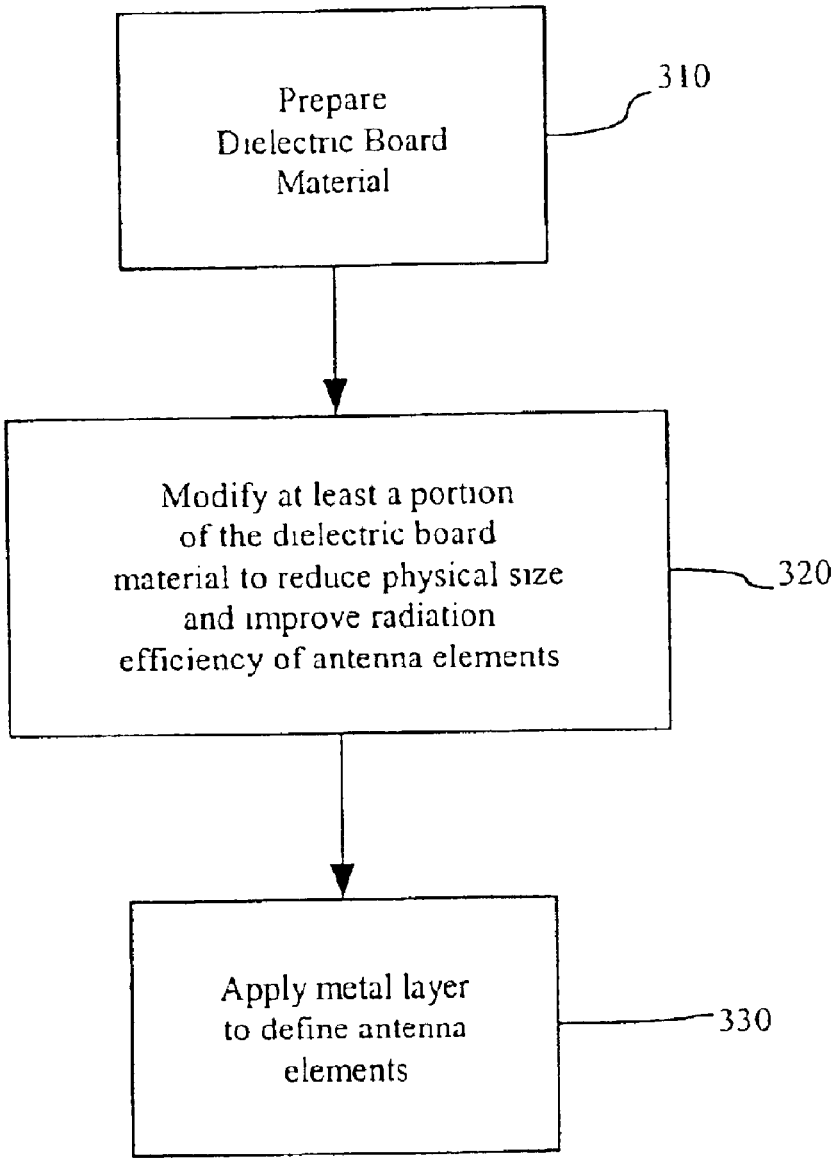
FIG. 3 is a flow chart that is useful for illustrating a process for manufacturing an antenna of reduced physical size and high radiation efficiency.

Dielectric substrate boards having metamaterial portions providing localized and selectable magnetic and dielectric properties can be prepared as shown in FIG. 3 for use as customized antenna substrates. In step 310, the dielectric board material can be prepared. In step 320, at least a portion of the dielectric board material can be modified using metamaterials, as described below, to reduce the physical size and achieve the best possible efficiency for the antenna, and associated circuitry. The modification can include creating voids in a dielectric material and filling some or substantially all of the voids with magnetic particles. Finally, a metal layer can be applied to define the conductive traces associated with the antenna elements and associated feed circuitry, such as patch radiators.

As defined herein, the term "metamaterials" refers to composite materials formed from the mixing or arrangement of two or more different materials at a very fine level, such as the angstrom or nanometer level. Metamaterials allow tailoring of electromagnetic properties of the composite, which can be defined by effective electromagnetic parameters comprising effective electrical permittivity $\in_{eff}$ (or dielectric constant) and the effective magnetic permeability $\mu_{eff}$.

The process for preparing and modifying the dielectric board material as described in steps 310 and 320 shall now be described in some detail. It should be understood, however, that the methods described herein are merely examples and the invention is not intended to be so limited.

Appropriate bulk dielectric substrate materials can be obtained from commercial materials manufacturers, such as DuPont and Ferro. The unprocessed material, commonly called Green Tape™, can be cut into sized portions from a bulk dielectric tape, such as into 6 inch by 6 inch portions. For example, DuPont Microcircuit Materials provides Green Tape material systems, such as 951 Low-Temperature Cofire Dielectric Tape and Ferro Electronic Materials ULF28-30 Ultra Low Fire COG dielectric formulation. These substrate materials can be used to provide dielectric layers having relatively moderate dielectric constants with accompanying relatively low loss tangents for circuit operation at microwave frequencies once fired.

In the process of creating a microwave circuit using multiple sheets of dielectric substrate material, features such as vias, voids, holes, or cavities can be punched through one or more layers of tape. Voids can be defined using mechanical means (e.g. punch) or directed energy means (e.g., laser drilling, photolithography), but voids can also be defined using any other suitable method. Some vias can reach through the entire thickness of the sized substrate, while some voids can reach only through varying portions of the substrate thickness.

The vias can then be filled with metal or other dielectric or magnetic materials, or mixtures thereof, usually using stencils for precise placement of the backfill materials. The individual layers of tape can be stacked together in a conventional process to produce a complete, multi-layer substrate. Alternatively, individual layers of tape can be stacked together to produce an incomplete, multi-layer substrate generally referred to as a sub-stack.

Voided regions can also remain voids. If backfilled with selected materials, the selected materials preferably include metamaterials. The choice of a metamaterial composition can provide tunable effective dielectric constants over a relatively continuous range from less than 2 to about 2650. Tunable magnetic properties are also available from certain metamaterials. For example, through choice of suitable materials the relative effective magnetic permeability generally can range from about 4 to 116 for most practical RF applications. However, the relative effective magnetic permeability can be as low as 2 or reach into the thousands.

A given dielectric substrate may be differentially modified. The term "differentially modified" as used herein refers to modifications, including dopants, to a dielectric substrate layer that result in at least one of the dielectric and magnetic properties being different at one portion of the substrate as compared to another portion. A differentially modified board substrate preferably includes one or more metamaterial containing regions. For example, the modification can be selective modification where certain dielectric layer portions are modified to produce a first set of dielectric or magnetic properties, while other dielectric layer portions are modified differentially or left unmodified to provide dielectric and/or magnetic properties different from the first set of properties. Differential modification can be accomplished in a variety of different ways.

According to one embodiment, a supplemental dielectric layer can be added to the dielectric layer. Techniques known in the art such as various spray technologies, spin-on technologies, various deposition technologies or sputtering can be used to apply the supplemental dielectric layer. The supplemental dielectric layer can be selectively added in localized regions, including inside voids or holes, or over the entire existing dielectric layer. For example, a supplemental dielectric layer can be used for providing a substrate portion having an increased effective dielectric constant. The dielectric material added as a supplemental layer can include various polymeric materials.

The differential modifying step can further include locally adding additional material to the dielectric layer or supplemental dielectric layer. The addition of material can be used to further control the effective dielectric constant or magnetic properties of the dielectric layer to achieve a given design objective.

The additional material can include a plurality of metallic and/or ceramic particles. Metal particles preferably include iron, tungsten, cobalt, vanadium, manganese, certain rare-earth metals, nickel or niobium particles. The particles are preferably nanometer size particles, generally having sub-micron physical dimensions, hereafter referred to as nanoparticles.

The particles, such as nanoparticles, can preferably be organofunctionalized composite particles. For example, organofunctionalized composite particles can include particles having metallic cores with electrically insulating coatings or electrically insulating cores with a metallic coating.

Magnetic metamaterial particles that are generally suitable for controlling magnetic properties of dielectric layer for a variety of applications described herein include ferrite organoceramics (FexCyHz)-(Ca/Sr/Ba-Ceramic). These particles work well for applications in the frequency range of 8–40 GHz. Alternatively, or in addition thereto, niobium organoceramics (NbCyHz)-(Ca/Sr/Ba-Ceramic) are useful for the frequency range of 12–40 GHz. The materials designated for high frequency are also applicable to low frequency applications. These and other types of composite particles can be obtained commercially.

In general, coated particles are preferable for use with the present invention as they can aid in binding with a polymer matrix or side chain moiety. In addition to controlling the magnetic properties of the dielectric, the added particles can also be used to control the effective dielectric constant of the material. Using a fill ratio of composite particles from approximately 1 to 70%, it is possible to raise and possibly lower the dielectric constant of substrate dielectric layer and/or supplemental dielectric layer portions significantly. For example, adding organofunctionalized nanoparticles to a dielectric layer can be used to raise the dielectric constant of the modified dielectric layer portions.

Particles can be applied by a variety of techniques including polyblending, mixing and filling with agitation. For example, a dielectric constant may be raised from a value of 2 to as high as 10 by using a variety of particles with a fill ratio of up to about 70%. Metal oxides useful for this purpose can include aluminum oxide, calcium oxide, magnesium oxide, nickel oxide, zirconium oxide and niobium (II, IV and V) oxide. Lithium niobate ($LiNbO_3$), and zirconates, such as calcium zirconate and magnesium zirconate, also may be used.

The selectable dielectric properties can be localized to areas as small as about 10 nanometers, or cover large area regions, including the entire board substrate surface. Conventional techniques such as lithography and etching along with deposition processing can be used for localized dielectric and magnetic property manipulation.

Materials can be prepared mixed with other materials or including varying densities of voided regions (which generally introduce air) to produce effective relative dielectric constants in a substantially continuous range from 2 to about 2650, as well as other potentially desired substrate properties. For example, materials exhibiting a low dielectric constant (<2 to about 4) include silica with varying densities of voided regions. Alumina with varying densities of voided regions can provide a relative dielectric constant of about 4 to 9. Neither silica nor alumina have any significant magnetic permeability. However, magnetic particles can be added, such as up to 20 wt. %, to render these or any other material significantly magnetic. For example, magnetic properties may be tailored with organofunctionality. The impact on dielectric constant from adding magnetic materials generally results in an increase in the dielectric constant.

Medium dielectric constant materials have a relative dielectric constant generally in the range of 70 to 500+/−10%. As noted above these materials may be mixed with other materials or voids to provide desired effective dielectric constant values. These materials can include ferrite doped calcium titanate. Doping metals can include magnesium, strontium and niobium. These materials have a range of 45 to 600 in relative magnetic permeability.

For high dielectric constant applications, ferrite or niobium doped calcium or barium titanate zirconates can be used. These materials have a relative dielectric constant of about 2200 to 2650. Doping percentages for these materials are generally from about 1 to 10%. As noted with respect to other materials, these materials may be mixed with other materials or voids to provide desired effective dielectric constant values.

These materials can generally be modified through various molecular modification processing. Modification processing can include void creation followed by filling with materials such as carbon and fluorine based organofunctional materials, such as polytetrafluoroethylene PTFE.

Alternatively or in addition to organofunctional integration, processing can include solid freeform fabrication (SFF), photo, uv, x-ray, e-beam or ion-beam irradiation. Lithography can also be performed using photo, uv, x-ray, e-beam or ion-beam radiation.

Different materials, including metamaterials, can be applied to different areas on substrate layers (sub-stacks), so that a plurality of areas of the substrate layers (sub-stacks) have different dielectric and/or magnetic properties. The backfill materials, such as noted above, may be used in conjunction with one or more additional processing steps to attain desired, dielectric and/or magnetic properties, either locally or over a bulk substrate portion.

A top layer conductor print is then generally applied to the modified substrate layer, sub-stack, or complete stack. Conductor traces can be provided using thin film techniques, thick film techniques, electroplating or any other suitable technique. The processes used to define the conductor pattern include, but are not limited to standard lithography and stencil.

A base plate is then generally obtained for collating and aligning a plurality of modified board substrates. Alignment holes through each of the plurality of substrate boards can be used for this purpose.

The plurality of layers of substrate, one or more sub-stacks, or combination of layers and sub-stacks can then be laminated (e.g. mechanically pressed) together using either isostatic pressure, which puts pressure on the material from all directions, or uniaxial pressure, which puts pressure on the material from only one direction. The laminate substrate is then further processed as described above or placed into an oven to be fired to a temperature suitable for the processed substrate (approximately 850° C. to 900° C. for the materials cited above).

The plurality of ceramic tape layers and stacked substacks of substrates can then be fired, using a suitable furnace that can be controlled to rise in temperature at a rate suitable for the substrate materials used. The process conditions used, such as the rate of increase in temperature, final temperature, cool down profile, and any necessary holds, are selected mindful of the substrate material and any material backfilled therein or deposited thereon. Following firing, stacked substrate boards, typically, are inspected for flaws using an acoustic, optical, scanning electron, or X-ray microscope.

The stacked ceramic substrates can then be optionally diced into cingulated pieces as small as required to meet circuit functional requirements. Following final inspection, the cingulated substrate pieces can then be mounted to a test fixture for evaluation of their various characteristics, such as to assure that the dielectric, magnetic and/or electrical characteristics are within specified limits.

Thus, dielectric substrate materials can be provided with localized tunable dielectric and magnetic characteristics for improving the density and performance of circuits, including those comprising microstrip antennas, such as slot fed microstrip antennas.

EXAMPLES

Several specific examples dealing with impedance matching using dielectrics including magnetic particles according to the invention is now presented. Impedance matching from the feed into the slot, as well as the slot and the environment (e.g. air) is demonstrated.

The equation for normal incidence ($\theta_i=0^0$) of a plane wave at the interface between two lossless dielectric mediums, which is $$\frac{\mu_n}{\varepsilon_n} = \frac{\mu_m}{\varepsilon_m},$$

is used for an impedance match between the dielectric medium in the slot and the adjacent dielectric medium, for example, an air environment (e.g. a slot antenna with air above) or another dielectric (e.g. antenna dielectric in the case of a patch antenna). The match into the environment is frequency independent. In many applications, assuming that the angle of incidence is zero is a generally reasonable approximation. However, when the angle of incidence is substantially greater than zero, cosine terms should be used along with the above equations.

The materials considered are all assumed to be isotropic. A computer program can be used to calculate these parameters. However, since magnetic materials for microwave circuits have not be used before the invention, no software currently exists for calculating the required material parameters necessary for impedance matching.

The computations presented were simplified in order to illustrate the physical principles involved. A more rigorous approach, such as a finite element analysis can be used to model the problems presented herein with additional accuracy.

Example 1

Slot With Air Above

Figure 4:
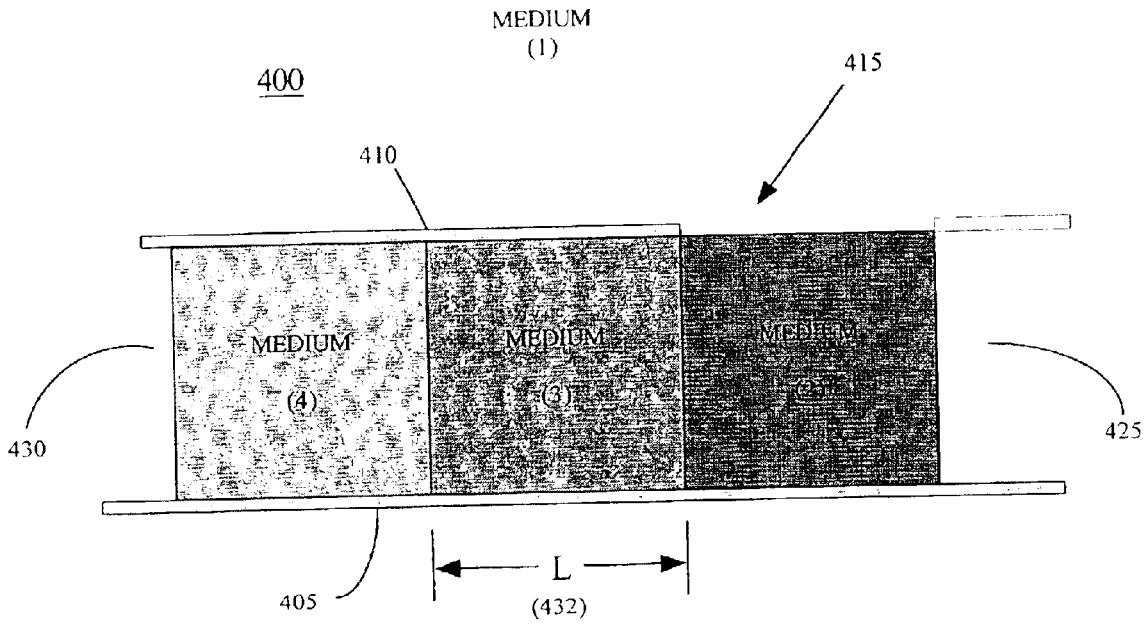
FIG. 4 is a side view of a slot fed microstrip antenna formed on an antenna dielectric which includes magnetic particles, the antenna providing impedance matching from the feed line into the slot, and the slot into the environment, according to an embodiment of the invention.

Referring to FIG. 4, a slot antenna 400 is shown having air (medium 1) above. Antenna 400 comprises transmission line 405 and ground plane 410, the ground plane including slot 415. A dielectric 430 having $\in_r=7.8$ is disposed between transmission line 405 and ground plane 410 and comprises region/medium 4, region/medium 3 and region/medium 2. Region 3 has an associated length (L) which is indicated by reference 432. Region 425 is assumed to have little bearing on this analysis, and is thus neglected herein because it would add additional complexity not needed in order to explain the physical processes of interest.

The magnetic permeability values for medium 2 and 3 ($\mu_{r_2}$ and $\mu_{r_3}$) are determined based on impedance matching adjacent medium. Specifically, $\mu_{r_2}$ is determined to permit impedance matching medium 2 into the environment (Medium 1), while $\mu_{r_3}$ is determined to permit impedance matching medium 2 to medium 4. In addition, a length of the matching section in medium 3 is then determined which has a length of a quarter wavelength at a selected operating frequency to match mediums 2 and 4.

First, medium 1 and 2 are impedance matched to theoretically eliminate the reflection coefficient at their interface using the equation:

$$\frac{\mu_{r_1}}{\varepsilon_{r_1}} = \frac{\mu_{r_2}}{\varepsilon_{r_2}} \tag{0.1}$$

the following results, $$\mu_{r_2} = \mu_{r_1}\frac{\varepsilon_{r_2}}{\varepsilon_{r_1}} = 1\cdot\frac{7.8}{1} \qquad \mu_{r_2} = 7.8 \tag{0.2}$$

Thus, to match the slot into the environment (e.g. air) $\mu_{r2}=7.8$.

Next, medium 4 can be impedance matched to medium 2. Medium 3 is used to match medium 2 to 4 using a length (L) of matching section 432 in region 3 having an electrical length of a quarter wavelength at a selected operating frequency, assumed to be 3 GHz. Thus, matching section 432 functions as a quarter wave transformer. To match medium 4 and medium 2, a quarter wave section 432 is required to have an intrinsic impedance of:

$$\eta_3=\sqrt{\eta_2\cdot\eta_4} \tag{0.3}$$

The intrinsic impedance for region 2 is:

$$\eta_2 = \sqrt{\frac{\mu_2}{\varepsilon_2}} = \sqrt{\frac{\mu_{r_2}\cdot\mu_0}{\varepsilon_{r_2}\cdot\varepsilon_0}} = \sqrt{\frac{\mu_{r_2}}{\varepsilon_{r_2}}}\sqrt{\frac{\mu_0}{\varepsilon_0}} \tag{0.4}$$

$$\eta_2 = \sqrt{\frac{\mu_{r_2}}{\varepsilon_{r_2}}}\,\eta_0$$

$\eta_0$ is the intrinsic impedance of free space, given by:

$$\eta_0=120\pi\Omega\approx377\Omega \tag{0.5}$$

hence, $\eta_2$ becomes, $$\eta_2 = \sqrt{\frac{7.8}{7.8}}\cdot 377\ \Omega = 377\ \Omega \tag{0.6}$$

The intrinsic impedance for region 4 is:

$$\eta_4 = \sqrt{\frac{\mu_{r_4}}{\varepsilon_{r_4}}}\,\eta_0 = \sqrt{\frac{1}{7.8}}\cdot 377\ \Omega \approx 135\ \Omega \tag{0.7}$$

Substituting (0.7) and (0.6) in (0.3) gives, $$\eta_3=\sqrt{377\cdot 135}\Omega=225.6\Omega \tag{0.8}$$

Then, the relative permeability in medium 3 is found as:

$$\eta_3 = 225.6\ \Omega = \sqrt{\frac{\mu_{r_3}}{\varepsilon_{r_3}}}\cdot\eta_0 = \sqrt{\frac{\mu_{r_3}}{7.8}}\cdot 377 \tag{0.9}$$

$$\mu_{r_3} = 7.8\cdot\left(\frac{225.6}{377}\right)^2 = 2.79$$

The guided wavelength in medium 3 at 3 GHz, is given by $$\lambda_3 = \frac{c}{f}\frac{1}{\sqrt{\varepsilon_{r_3}\cdot\mu_{r_3}}} = \frac{3\times 10^{10}\ \text{cm/s}}{3\times 10^{9}\ \text{Hz}}\cdot\frac{1}{\sqrt{7.8\cdot 2.79}} = 2.14\ \text{cm} \tag{0.10}$$

where c is the speed of light, and f is the frequency of operation.

Consequently, the length (L) of quarter wave matching section 432 is given by $$L = \frac{\lambda_3}{4} = \frac{2.14}{4}\ \text{cm} = 0.536\ \text{cm} \tag{0.11}$$

Example 2

Slot with dielectric Above, the dielectric having a relative permeability of 1 and a dielectric constant of 10.

Figure 5:
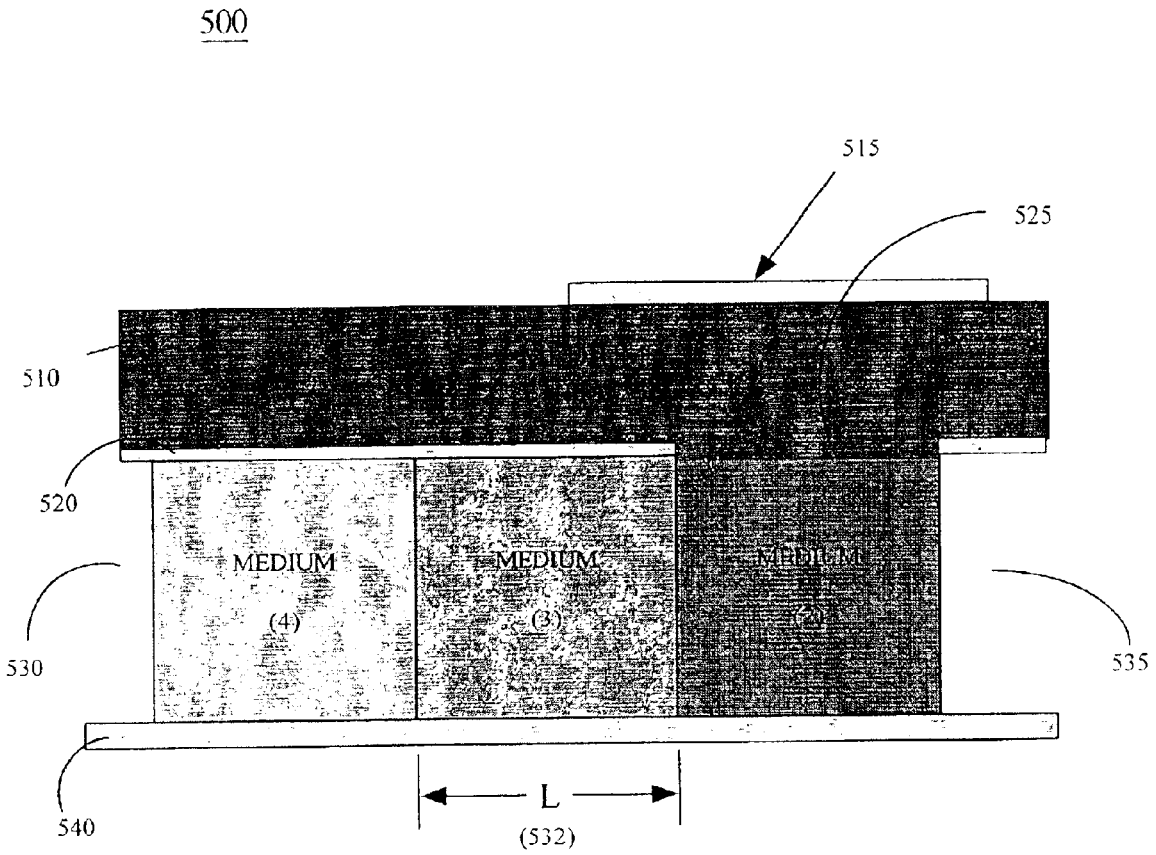
FIG. 5 is a side view of a slot fed microstrip patch antenna formed on an antenna dielectric which includes magnetic particles, the antenna providing impedance matching from the feed line into the slot, and the slot to its interface with the antenna dielectric beneath the patch, according to an embodiment of the invention.

Referring to FIG. 5, a side view of a slot fed microstrip patch antenna 500 is shown formed on an antenna dielectric 510 which provides $\in_r$=10 and $\mu_r$=1. Antenna 500 includes patch 515 and ground plane 520. Ground plane 520 includes a cutout region comprising slot 525. Feed line dielectric 530 is disposed between ground plane 520 and feed line 540.

The feed line dielectric 530 comprises region/medium 4, region/medium 3 and region/medium 2. Region/medium 3 has an associated length (L) which is indicated by reference 532. Region 535 is assumed to have little bearing on this analysis and is thus neglected.

Since the relative permeability of the antenna dielectric is equal to 1 and the dielectric constant is 10, the antenna dielectric is clearly not matched to air as equal relative permeability and relative permittivity, such as $\mu_r$=10 and $\in_r$=10 for the antenna dielectric would be required. Although not demonstrated in this example, such a match can be implemented using the invention. In this example, permeability for mediums 2 and 3 are calculated for optimum impedance matching between mediums 2 and 4 as well as between mediums 1 and 2. In addition, a length of the matching section in medium 3 is then determined which has a length of a quarter wavelength at a selected operating frequency. In this example, the unknowns are again $\mu_{r_2}$, $\mu_{r_3}$ and L. First, using the equation $$\frac{\mu_{r_1}}{\varepsilon_{r_1}} = \frac{\mu_{r_2}}{\varepsilon_{r_2}} \tag{0.12}$$

the following results:

$$\mu_{r_2} = \mu_{r_1}\frac{\varepsilon_{r_2}}{\varepsilon_{r_1}} = 1\cdot\frac{7.8}{10} = 0.78 \tag{0.13}$$

In order to match medium 2 to medium 4, a quarter wave section 532 is required with an intrinsic impedance of $$\eta_3=\sqrt{\eta_2\cdot\eta_4} \tag{0.14}$$

The intrinsic impedance for medium 2 is $$\eta_2 = \sqrt{\frac{\mu_2}{\varepsilon_2}} = \sqrt{\frac{\mu_{r_2}\cdot\mu_0}{\varepsilon_{r_2}\cdot\varepsilon_0}} = \sqrt{\frac{\mu_{r_2}}{\varepsilon_{r_2}}}\sqrt{\frac{\mu_0}{\varepsilon_0}} \tag{0.15}$$

$$\eta_2 = \sqrt{\frac{\mu_{r_2}}{\varepsilon_{r_2}}}\,\eta_0$$

$\eta_0$ is the intrinsic impedance of free space, given by $$\eta_0=120\ \pi\Omega\approx 377\Omega \tag{0.16}$$

hence, $\eta_2$ becomes, $$\eta_2 = \sqrt{\frac{0.78}{7.8}}\cdot 377\ \Omega = 119.2\ \Omega \tag{0.17}$$

The intrinsic impedance for medium 4 is $$\eta_4 = \sqrt{\frac{\mu_{r_4}}{\varepsilon_{r_4}}}\,\eta_0 = \sqrt{\frac{1}{7.8}}\cdot 377\ \Omega \approx 135\ \Omega \tag{0.18}$$

Substituting (0.18) and (0.17) in (0.14) gives, $$\eta_3=\sqrt{119.2\cdot 135}\Omega=126.8\Omega \tag{0.19}$$

Then, the relative permeability for medium 3 is found as $$\eta_3 = 126.8\ \Omega = \sqrt{\frac{\mu_{r_3}}{\varepsilon_{r_3}}}\cdot\eta_0 = \sqrt{\frac{\mu_{r_3}}{7.8}}\cdot 377 \tag{0.20}$$

$$\mu_{r_3} = 7.8\cdot\left(\frac{126.8}{377}\right)^2 = 0.8823$$

The guided wavelength in medium (3), at 3 GHz, is given by $$\lambda_3 = \frac{c}{f}\frac{1}{\sqrt{\varepsilon_{r_3}\cdot\mu_{r_3}}} = \frac{3\times 10^{10}\ \text{cm/s}}{3\times 10^{9}\ \text{Hz}}\cdot\frac{1}{\sqrt{7.8\cdot 0.8823}} = 3.81\ \text{cm} \tag{0.21}$$

where c is the speed of light and f is the frequency of operation. Consequently, the length L is given by $$L = \frac{\lambda_3}{4} = \frac{3.81}{4}\ \text{cm} = 0.952\ \text{cm} \tag{0.22}$$

Since relative permeability values required for impedance matching are substantially less than one, such matching will be difficult to implement with existing materials. Therefore, the practical implementation of this example will require the development of new materials tailored specifically for this or similar applications which require a medium having a relative permeability substantially less than 1.

Example 3

Slot with dielectric above, that has a relative permeability of 10, and a dielectric constant of 20.

This example is analogous to example 2, having the structure shown in FIG. 5, except the $\in_r$ of the antenna dielectric 510 is 20. Since the relative permeability of antenna dielectric 510 is =10, and it is different from its permittivity, antenna dielectric 510 is again not matched to air. In this example, as in the previous example, the permeability for mediums 2 and 3 for optimum impedance matching between mediums 2 and 4 as well as between medium 1 and 2 are calculated. In addition, a length of the matching section in medium 3 is then determined which has a length of a quarter wavelength at a selected operating frequency. As before, $\mu_{r_2}$, $\mu_{r_3}$ and L will be determined to impedance match adjacent dielectric media. First, using the equation $$\frac{\mu_{r_1}}{\varepsilon_{r_1}} = \frac{\mu_{r_2}}{\varepsilon_{r_2}} \tag{0.23}$$

the following results, $$\mu_{r_2} = \mu_{r_1}\frac{\varepsilon_{r_2}}{\varepsilon_{r_1}} = 10\cdot\frac{7.8}{20} = 3.9 \tag{0.24}$$

In order to match medium 2 to medium 4, a quarter wave section is required with an intrinsic impedance of $$\eta_3=\sqrt{\eta_2\cdot\eta_4} \tag{0.25}$$

The intrinsic impedance for medium 2 is $$\eta_2 = \sqrt{\frac{\mu_2}{\varepsilon_2}} = \sqrt{\frac{\mu_{r_2}\cdot\mu_0}{\varepsilon_{r_2}\cdot\varepsilon_0}} = \sqrt{\frac{\mu_{r_2}}{\varepsilon_{r_2}}}\sqrt{\frac{\mu_0}{\varepsilon_0}} \tag{0.26}$$

$$\eta_2 = \sqrt{\frac{\mu_{r_2}}{\varepsilon_{r_2}}}\,\eta_0$$

$\eta_0$ is the intrinsic impedance of free space, given by $$\eta_0=120\pi\Omega\approx377\Omega \tag{0.27}$$

hence, $\eta_2$ becomes, $$\eta_2 = \sqrt{\frac{3.9}{7.8}}\cdot377\ \Omega = 266.58\ \Omega \tag{0.28}$$

The intrinsic impedance for medium (4) is $$\eta_4 = \sqrt{\frac{\mu_{r_4}}{\varepsilon_{r_4}}}\,\eta_0 = \sqrt{\frac{1}{7.8}}\cdot377\ \Omega \approx 135\ \Omega \tag{0.29}$$

Substituting (0.29) and (0.28) in (0.25) gives, $$\eta_3=\sqrt{266.58\cdot135}\Omega=189.7\Omega \tag{0.30}$$

Then, the relative permeability for medium (3) is found as $$\eta_3 = 189.7\ \Omega = \sqrt{\frac{\mu_{r_3}}{\varepsilon_{r_3}}}\cdot\eta_0 = \sqrt{\frac{\mu_{r_3}}{7.8}}\cdot377 \tag{0.31}$$

$$\mu_{r_3} = 7.8\cdot\left(\frac{189.7}{377}\right)^2 = 1.975$$

The guided wavelength in medium 3, at 3 GHz, is given by $$\lambda_3 = \frac{c}{f}\frac{1}{\sqrt{\varepsilon_{r_3}\cdot\mu_{r_3}}} \tag{0.32}$$

$$= \frac{3\times10^{10}\ \text{cm/s}}{3\times10^{9}\ \text{Hz}}\cdot\frac{1}{\sqrt{7.8\cdot1.975}}$$

$$= 2.548\ \text{cm}$$

where c is the speed of light and f is the frequency of operation. Consequently, the length 532 (L) is given by $$L = \frac{\lambda_3}{4} = \frac{2.548}{4}\text{cm} = 0.637\ \text{cm} \tag{0.33}$$

Comparing Examples 2 and 3, through use of an antenna dielectric 510 having a relative permeability substantially greater than 1 facilitates impedance matching between mediums 1 and 2, as well as between mediums 2 and 4, as the required permeabilities for medium 2 and 3 for matching these mediums are both readily realizable as described herein.

After having been described, it will be clear that the invention is not so limited. Numerous modifications, changes, variations, substitutions and equivalents will occur to those skilled in the art without departing from the spirit and scope of the present invention as described in the claims.

What is claimed is:

1. A slot fed microstrip patch antenna, comprising:

an electrically conducting ground plane, said ground plane having at least one slot;

at least a first patch radiator;

an antenna dielectric substrate material disposed between said ground plane and said first patch radiator, wherein at least a portion of said antenna dielectric includes magnetic particles;

a feed line for providing signal energy to or from said first patch radiator through said slot, and a feed dielectric substrate disposed between said feed line and said ground plane.

2. The antenna of claim 1, wherein said portion of said antenna dielectric is disposed between said slot and said patch.

3. The antenna of claim 1, wherein at least a portion of said feed dielectric substrate includes magnetic particles.

4. The antenna of claim 3, wherein said portion of said feed dielectric substrate is disposed between said slot and said feed line.

5. The antenna of claim 3, wherein said feed dielectric substrate provides a quarter wavelength matching section proximate to said slot to match said feed line into said slot.

6. A slot fed microstrip patch antenna, comprising:

an electrically conducting ground plane, said ground plane having at least one slot;

at least a first patch radiator;

an antenna dielectric substrate material disposed between said ground plane and said first patch radiator, wherein at least a portion of said antenna dielectric includes magnetic particles, and wherein said magnetic particles comprise metamaterials;

a feed line for providing signal energy to or from said first patch radiator through said slot, and a feed dielectric substrate disposed between said feed line and said ground plane.

7. A slot fed microstrip patch antenna, comprising:

an electrically conducting ground plane, said ground plane having at least one slot;

at least a first patch radiator;

an antenna dielectric substrate material disposed between said ground plane and said first patch radiator, wherein at least a portion of said antenna dielectric includes magnetic particles;

a feed line for providing signal energy to or from said first patch radiator through said slot, and a feed dielectric substrate disposed between said feed line and said ground plane, wherein at least a portion of said feed dielectric substrate includes magnetic particles, wherein said feed dielectric substrate provides a quarter wavelength matching section proximate to said slot to match said feed line into said slot, and wherein said quarter wave matching section includes magnetic particles.

8. A slot fed microstrip patch antenna, comprising:

an electrically conducting ground plane, said ground plane having at least one slot;

at least a first patch radiator, wherein said at least a first patch radiator comprises a first and a second patch radiator, said first and said second patch radiators separated by an inter-patch dielectric;

an antenna dielectric substrate material disposed between said ground plane and said first patch radiator, wherein at least a portion of said antenna dielectric includes magnetic particles;

a feed line for providing signal energy to or from said first patch radiator through said slot, and a feed dielectric substrate disposed between said feed line and said ground plane.

9. The antenna of claim 8, wherein said inter-patch dielectric includes magnetic particles.

10. The antenna of claim 9, wherein said magnetic particles comprise metamaterials.

* * * * *